US010418204B2

(12) United States Patent
Hayashi et al.

(10) Patent No.: US 10,418,204 B2
(45) Date of Patent: Sep. 17, 2019

(54) SWITCH DEVICE

(71) Applicant: ALPS ALPINE CO., LTD., Tokyo (JP)

(72) Inventors: Makoto Hayashi, Miyagi-ken (JP); Hisato Shimomura, Miyagi-ken (JP); Hidekazu Kato, Miyagi-ken (JP); Tatsuaki Kawase, Miyagi-ken (JP)

(73) Assignee: ALPS ALPINE CO., LTD., Tokyo (JP)

( * ) Notice: Subject to any disclaimer, the term of this patent is extended or adjusted under 35 U.S.C. 154(b) by 13 days.

(21) Appl. No.: 15/666,683

(22) Filed: Aug. 2, 2017

(65) Prior Publication Data

US 2018/0068809 A1 Mar. 8, 2018

(30) Foreign Application Priority Data

Sep. 5, 2016 (JP) ..... 2016-172442

(51) Int. Cl.

| | |
|---|---|
| ***H01H 13/14*** | (2006.01) |
| ***H01H 1/26*** | (2006.01) |
| ***H01H 13/52*** | (2006.01) |
| ***H01H 13/04*** | (2006.01) |
| ***H01H 13/50*** | (2006.01) |

(52) U.S. Cl.

CPC ..... *H01H 13/14* (2013.01); *H01H 1/26* (2013.01); *H01H 13/04* (2013.01); *H01H 13/50* (2013.01); *H01H 13/52* (2013.01); *H01H 2205/014* (2013.01)

(58) Field of Classification Search

CPC ..... H01H 13/14; H01H 13/04; H01H 13/50; H01H 2205/014; H01H 5/24

USPC ..... 200/402, 502, 511

See application file for complete search history.

(56) References Cited

U.S. PATENT DOCUMENTS

| | | | | |
|---|---|---|---|---|
| 2,568,476 A * | 9/1951 | Weirich | H01H 37/52 | 200/404 |
| 5,046,227 A * | 9/1991 | Akiike | H01H 83/223 | 200/407 |
| 2004/0069606 A1* | 4/2004 | Lee | H01H 13/36 | 200/402 |
| 2005/0109601 A1* | 5/2005 | Collot | H01H 13/36 | 200/402 |

FOREIGN PATENT DOCUMENTS

JP 2001-332152 A 11/2001

* cited by examiner

*Primary Examiner* — Edwin A. Leon
*Assistant Examiner* — Iman Malakooti
(74) *Attorney, Agent, or Firm* — Brinks Gilson & Lione

(57) ABSTRACT

A switch device includes a housing, an operating member, a fixed contact, and a moving contact. The moving contact is, while being in contact with the fixed contact, urged toward the fixed contact so as to be in elastic contact with the fixed contact. The fixed contact includes a plate portion and is held by the housing with a space on one surface side of the plate portion. The moving contact includes a first extended portion that extends so as to intersect the plate portion. When the moving contact and the fixed contact are in contact with each other, the first extended portion intersects the plate portion while being inclined relative to the plate portion, and the first extended portion is in elastic contact with a corner portion on a one surface side of an edge of the plate portion.

7 Claims, 11 Drawing Sheets

SWITCH DEVICE

CLAIM OF PRIORITY

This application claims benefit of priority to Japanese Patent Application No. 2016-172442 filed on Sep. 5, 2016, which is hereby incorporated by reference in its entirety.

BACKGROUND

1. Field of the Disclosure

The present disclosure relates to switch devices, and in particular, relates to a switch device with which contact pressure can be increased.

2. Description of the Related Art

Switch devices exist in which a moving contact is brought into contact with and brought out of contact from a fixed contact without using a wiper. As an example of such related-art switch devices, a miniature switch 900 described in Japanese Unexamined Patent Application Publication No. 2001-332152 is known. The miniature switch 900 is described with reference to FIGS. 11A and 11B.

As illustrated in FIG. 11A, in the miniature switch 900, a switch pin 923 that has a T-shape in section and is an operating member is inserted through a hole 922 formed in an upper portion of a switch body 921 that is a housing. When the switch pin 923 is not pressed, a metal terminal 924 that is a moving contact and a metal piece 931 that is a fixed contact are in contact with each other, thereby electrical conduction is made in the switch. Then, when the switch pin 923 is pressed, as illustrated in FIG. 11B, contact between the metal terminal 924 that is the moving contact and the metal piece 931 that is the fixed contact is open. Thus, the switch is off.

With such a structure, a metal-to-metal contact is used for opening and closing of the switch. Accordingly, wear is decreased and reliability is high.

However, in a switch device such as a miniature switch 900, the metal terminal 924 that is the moving contact and the metal piece 931 that is the fixed contact are in surface contact with each other. Thus, contact pressure cannot be increased. As a result, reliability of electrically conductive connection is not necessarily obtained. Furthermore, the moving contact and the fixed contact are in surface contact with each other. Thus, when foreign matter is caught at a part between the moving contact and the fixed contact, contact failure is likely to occur.

SUMMARY

A switch device includes a housing, an operating member, a fixed contact, and a moving contact. The housing has an opening. The operating member includes an operating portion exposed from the opening and is movable. The fixed contact is provided in the housing. The moving contact is driven along with a movement of the operating member so as to be brought into contact with and brought out of contact from the fixed contact. The moving contact is comprised of an elastic metal plate and is, while the moving contact is in contact with the fixed contact, urged toward the fixed contact so as to be in elastic contact with the fixed contact. The fixed contact includes a plate portion having a flat plate shape and is held by the housing with a space provided on one surface side of the plate portion located on an opposite side to a side where the operating member is disposed. The moving contact includes a first extended portion that extends so as to intersect the plate portion with one end portion of the first extended portion positioned on the one surface side of the plate portion. When the moving contact and the fixed contact are in contact with each other, the first extended portion intersects the plate portion while the first extended portion is inclined relative to the plate portion, and the first extended portion is in elastic contact with a corner portion on one surface side of an edge of the plate portion.

Thus, the contact between the moving contact and the fixed contact is not surface contact, and a contact region between the moving contact and the fixed contact is decreased. This can increase the contact pressure. As a result, reliability of electrically conductive connection can be improved.

DESCRIPTION OF THE EXEMPLARY EMBODIMENTS

Embodiments

Figure 1:
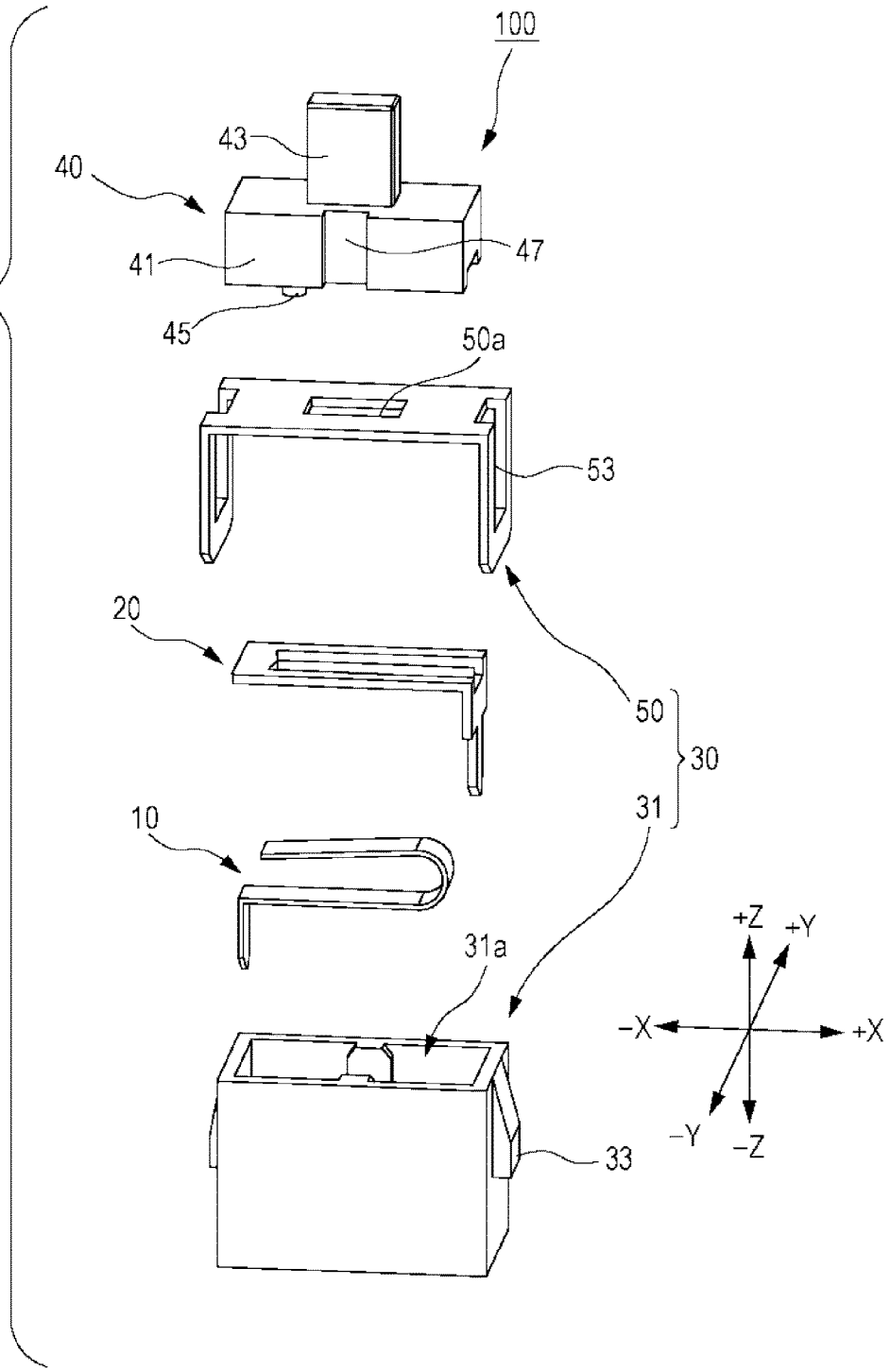
FIG. 1 is an exploded perspective view of members included in a switch device according to an embodiment of the present invention.

The present invention will be described below with reference to the drawings. A switch device 100 as an embodiment of the present invention is in the form of a push switch that is in a switched-on state before an operating portion is pressed and becomes a switched-off state when the operating portion is pressed. The switch device 100 is mounted in an electronic device of an on-vehicle apparatus or the like when used. Application of the switch device according to the present invention is not limited to the following description and can be appropriately changed. Herein, the terms including the right side, the left side, the rear side, the front side, the upper side, and the lower side may be used in description of the drawings for convenience. These refer to, in this order, the +X side, the −X side, the +Y side, the −Y side, the +Z side, and the −Z side in the drawings and do not limit an installation direction of the product or a usage direction of the product.

Figure 2:
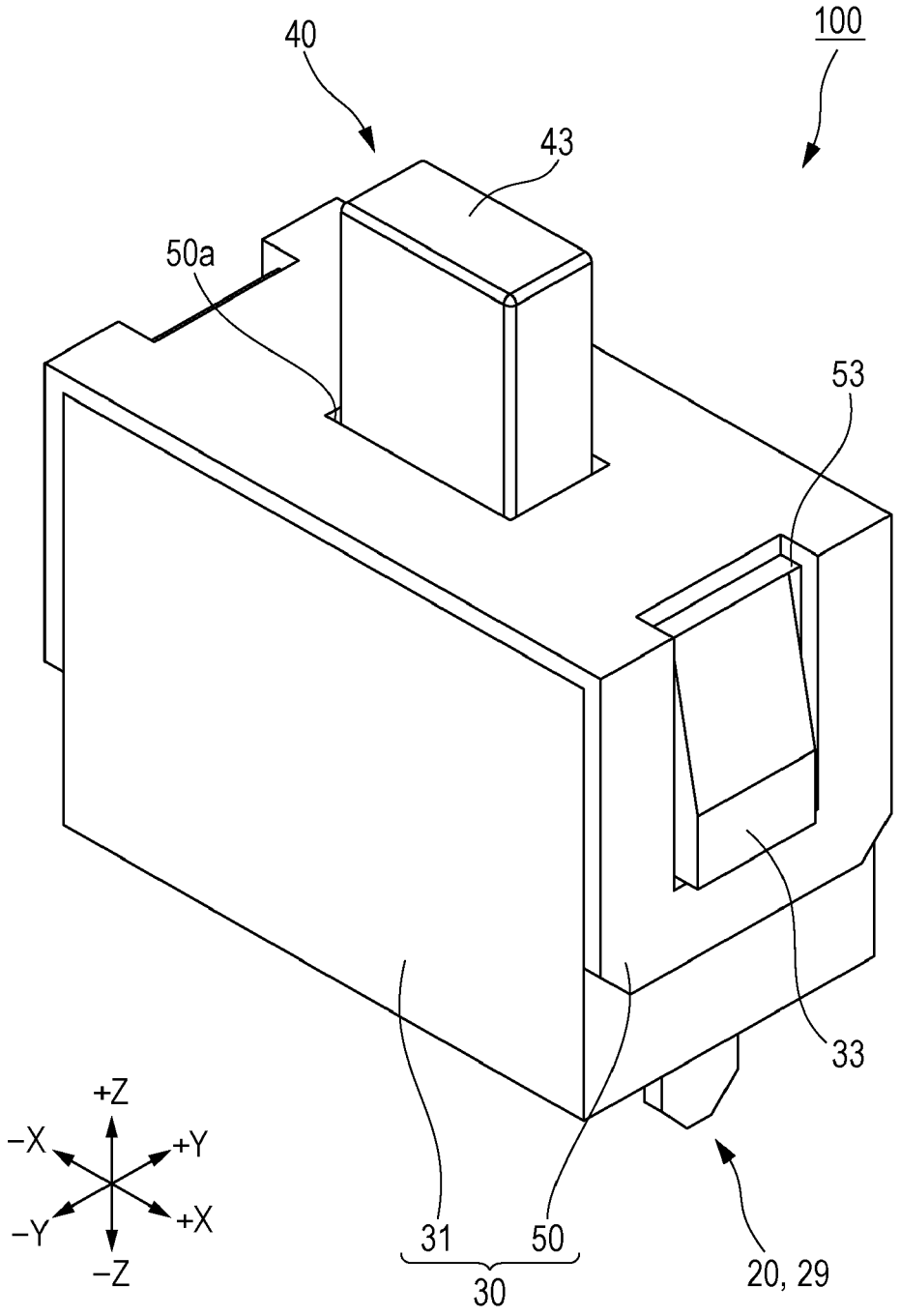
FIG. 2 is a perspective view of the appearance of the switch device.
Figure 3A:
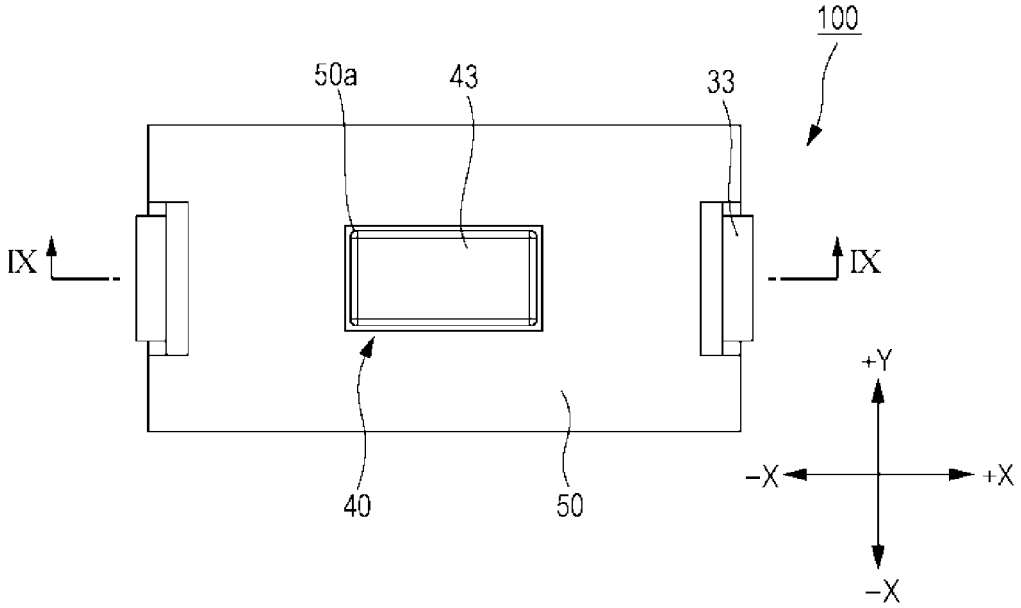
FIG. 3A is a plan view of the switch device.
Figure 3B:
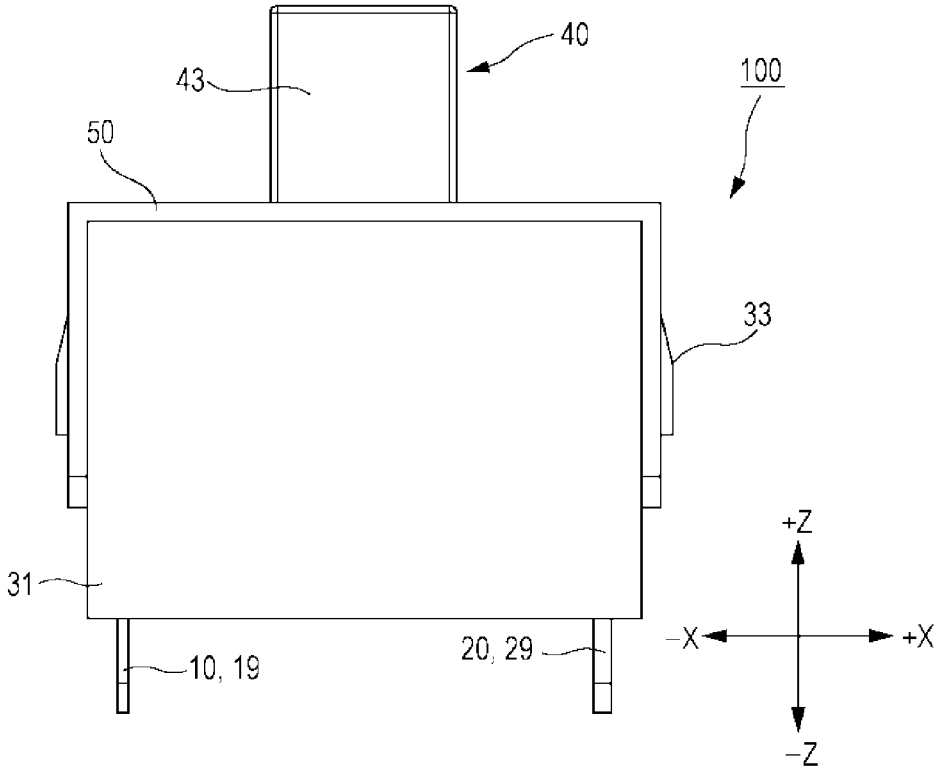
FIG. 3B is a front view of the switch device.

First, referring to FIGS. 1 to 3B, an overall structure of the switch device 100 is described. FIG. 1 is an exploded perspective view of members included in the switch device 100. FIG. 2 is a perspective view of the appearance of the switch device 100. FIG. 3A is a plan view of the switch device 100, and FIG. 3B is a front view of the switch device 100.

As illustrated in FIG. 1, the switch device 100 includes a housing 30 that includes a cover 50, an operating member 40, a fixed contact 20, and a moving contact 10. Preferably, the housing 30 includes a casing 31.

The casing 31 is formed of a synthetic resin material and has a containing portion 31*a* therein that is a space containing the moving contact 10, the fixed contact 20, and the operating member 40. Furthermore, the casing 31 has cover mounting portions 33 for mounting the cover 50. The cover mounting portions 33 are disposed on left and right outer walls of the casing 31. A structure inside the casing 31 will be described later.

The cover 50 is formed of a synthetic resin material. The cover 50 has mounting holes 53 on the left and right thereof. As illustrated in FIGS. 2, 3A and 3B, the cover 50 is snapped onto the cover mounting portions 33 of the casing 31 using the mounting holes 53 thereof. The cover 50 of the housing 30 has an opening 50*a* disposed at the center on an upper surface thereof. The opening 50*a* has a rectangular shape in plan view so as to follow the shape of an operating portion 43 of the operating member 40. The housing 30 that includes the cover 50 and the casing 31 has a substantially rectangular parallelepiped shape that extends in the left-right direction.

The operating member 40 is formed of a synthetic resin material and includes, as illustrated in FIG. 1, a main body 41, the operating portion 43, and a projection 45. The main body 41 has a substantially rectangular parallelepiped shape. The operating portion 43 projects upward from the main body 41. The projection 45 projects downward from the lower side of the main body 41. The projection 45 has a curved surface at its projecting end. The main body 41 also has slide grooves 47 that are formed at the centers in the front and rear surfaces of the main body 41 so as to extend in the up-down direction.

As illustrated in FIGS. 2, 3A and 3B, the operating member 40 is disposed such that the operating portion 43 thereof projects upward through the opening 50*a* of the housing 30. The operating member 40 is movable in the up-down direction in the housing 30.

As illustrated in FIGS. 2 and 3B, a terminal 19 of the moving contact 10 and a terminal 29 of the fixed contact 20 are exposed from the lower side of the housing 30 so as to extend downward from the casing 31. The terminal 19 of the moving contact 10 and the terminal 29 of the fixed contact 20 are connected to a circuit provided in an electronic device (not illustrated) to which the switch device 100 is attached. Structures of the fixed contact 20 and the moving contact 10 will be described later.

Figure 4:
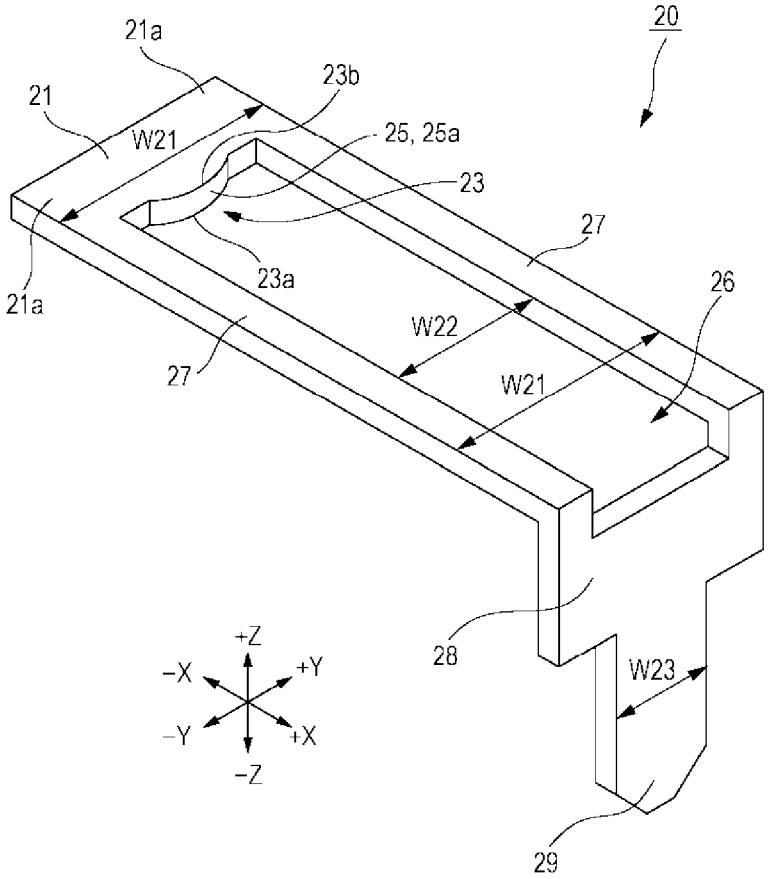
FIG. 4 is a perspective view of the structure of a fixed contact.
Figure 5:
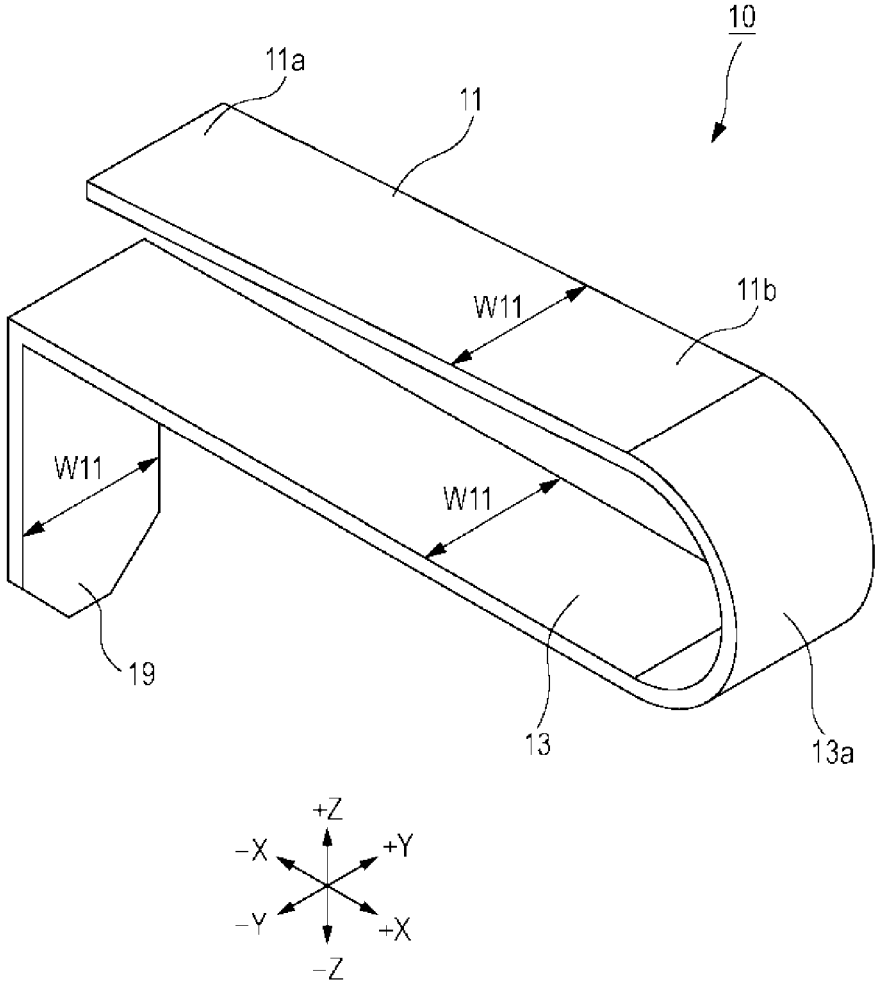
FIG. 5 is a perspective view of the structure of a moving contact.
Figure 6:
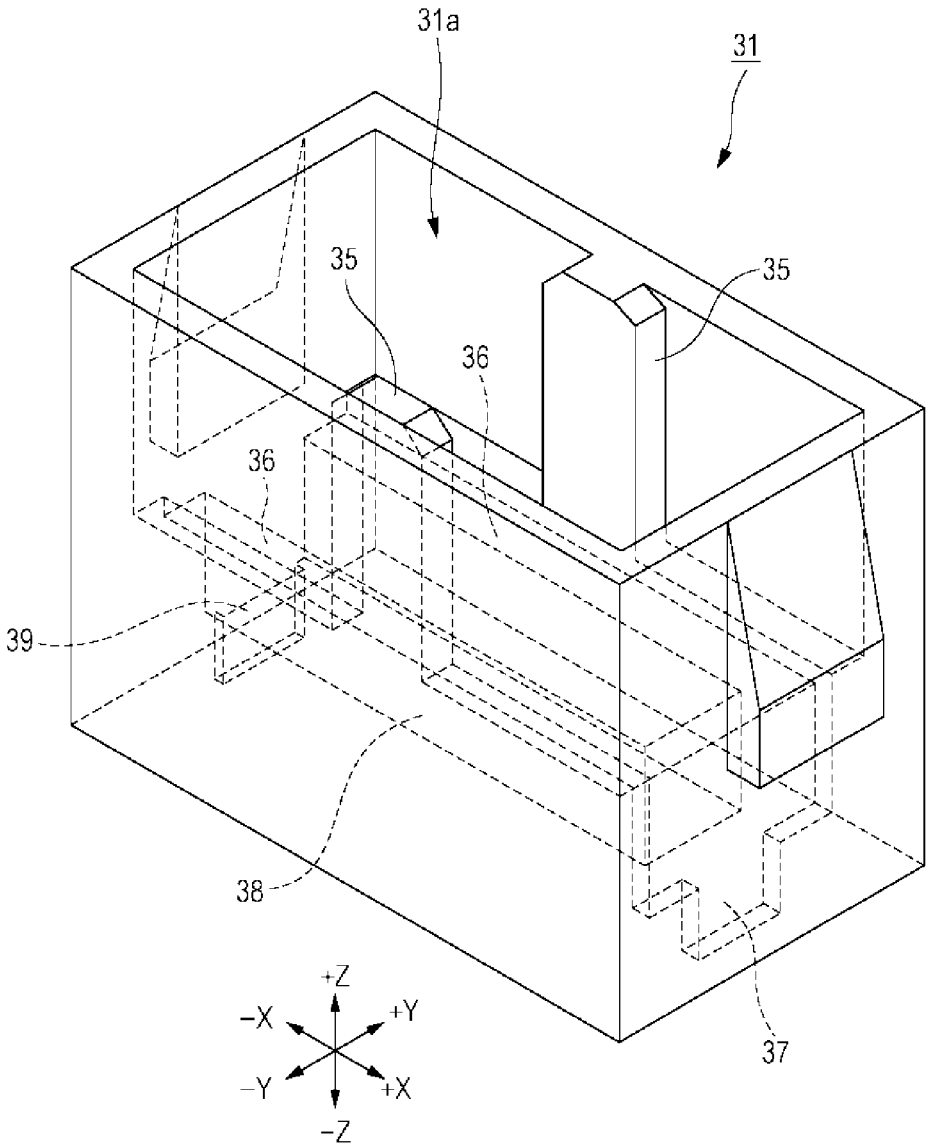
FIG. 6 is a perspective view of the structure of a casing.
Figure 7:
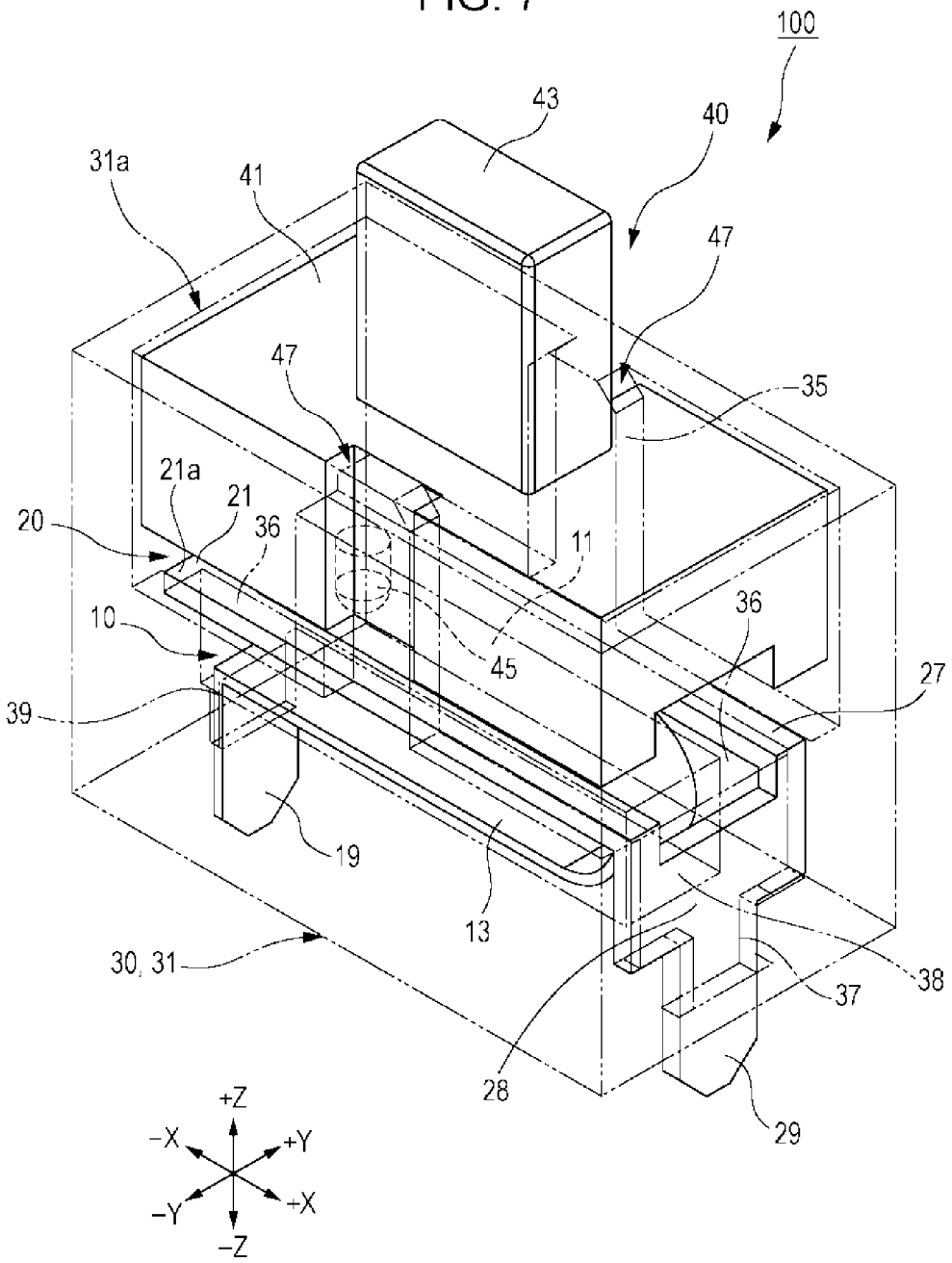
FIG. 7 is a perspective view of the inner structure of the switch device.

Next, referring to FIGS. 4 to 7, structures of the fixed contact 20, the moving contact 10, and the casing 31 and an inner structure of the switch device 100 are described. FIG. 4 is a perspective view of the structure of the fixed contact 20. FIG. 5 is a perspective view of the structure of the moving contact 10. FIG. 6 is a perspective view of the structure of the casing 31. FIG. 7 is a perspective view of the inner structure of the switch device 100. For ease of description, FIG. 7 schematically illustrates the inner structure of the switch device 100 by seeing the inner structure of the switch device 100 through the structure of the casing 31.

The fixed contact 20 is formed of a metal plate. As illustrated in FIG. 4, the fixed contact 20 includes a plate portion 21 having a flat plate shape. Preferably, the fixed contact 20 includes a pair of connecting portions 27 connected to respective end portions 21*a* of the plate portion 21. Preferably, the plate portion 21 together with the pair of connecting portions 27 forms an annular shape. The pair of connecting portions 27 extend rightward from the respective end portions 21*a* of the plate portion 21. Accordingly, a vacant region 26 having a substantially rectangular shape in plan view is formed in a space surrounded by the plate portion 21 and the pair of connecting portions 27.

The fixed contact 20 includes a vertical plate 28. The vertical plate 28 vertically downwardly extends from one end on the right side of each of the pair of connecting portions 27 so as to connect the one end on the right side of one of the pair of connecting portions 27 to the one end on the right side of the other of the pair of connecting portions 27. Furthermore, the terminal 29 having been described vertically downwardly extends at the center on the lower side of the vertical plate 28.

Preferably, the above-described plate portion 21 includes a projection 25 at the center of an edge 23 on the right side (on the +X side) thereof. The projection 25 has a curved surface 25*a* at least at a projecting end thereof. As illustrated in FIG. 4, the projection 25 extending along a plate surface of the plate portion 21 projects toward the +X side (toward the center of the vacant region 26). Preferably, the curved surface 25*a* has an arc shape according to the present embodiment. Furthermore, the edge 23 has a corner portion 23*a* on its lower side and another-surface-side corner portion 23*b* on its upper side. Herein, the corner portion on one surface side, that is, the lower side of the edge 23 of the plate portion 21 is referred to as the corner portion 23*a*, and the corner portion on the other surface side of the edge 23 of the plate portion 21 on the opposite side to the corner portion 23*a* is referred to as the other-surface-side corner portion 23*b*.

The fixed contact 20 is manufactured by using a die set (not illustrated) for pressing including a die and a punch. In the manufacture of the fixed contact 20, punching is performed so that the punch is moved from the lower side toward the upper side of the fixed contact 20. Preferably, punching burrs are formed at the other-surface-side corner portion 23*b* on the opposite side to the corner portion 23*a* of the fixed contact 20 when processing the fixed contact 20 by moving the punch from the lower side toward the upper side of the fixed contact 20. In other words, no punching burr remains at the corner portion 23*a* of the fixed contact 20. In an actual pressing of the fixed contact 20, a metal plate material of the fixed contact 20 is set upside down while the punch is moved from the upper side toward the lower side.

Although the projection 25 is provided at the center of the edge 23 on the right side of the plate portion 21 according to the present embodiment, the edge 23 on the right side of the plate portion 21 may have a straight line shape without the projection 25 according to the present invention.

Both the width between the end portions 21*a* of the plate portion 21 and the width between the outer sides of the pair of connecting portions 27 in the fixed contact 20 are the same width W21. The width W21 is set to a specified value. Furthermore, the width of the vacant region 26, that is, a dimension W22 between the pair of connecting portions 27 and a width W23 of the terminal 29 are set to specified values. The width W21 and the dimension W22 described above are set with the strength of the fixed contact 20 considered.

The moving contact 10 is formed of an elastic metal plate. As illustrated in FIG. 5, the moving contact 10 includes a first extended portion 11 that has a flat plate shape and extends rightward from one end portion 11*a*. Preferably, the moving contact 10 also includes a second extended portion 13 having one end integrally connected to the first extended portion 11 and the other end separated from and facing the one end portion 11*a* of the first extended portion 11. The other end of the second extended portion 13 is positioned below the one end portion 11*a* of the first extended portion 11. Furthermore, the terminal 19 having been described is formed at the other end of the second extended portion 13 so as to vertically downwardly extend.

At least one bent portion 13*a* is formed in the above-described second extended portion 13. According to the present embodiment, a single bent portion 13*a* is provided. One end of the bent portion 13*a* is integrally connected to another end portion 11*b* of the first extended portion 11. With the at least one bent portion 13*a* formed in the second extended portion 13, the length of the moving contact 10 can be increased. Increasing the length of the moving contact 10 allows stress received by the moving contact 10 to be decreased even when the moving contact 10 is pressed a plurality of times.

In the moving contact 10, all of a width W11 of the first extended portion 11, a width W11 of the second extended portion 13, and a width W11 of the terminal 19 are the same and set to a specified value. Preferably, the above-described dimension W22 between the pair of connecting portions 27 of the fixed contact 20 is set to be larger than the width W11 of the first extended portion 11 and the second extended portion 13 of the moving contact 10. Accordingly, the first extended portion 11 of the moving contact 10 except for the one end portion 11*a* is contained between the pair of connecting portions 27, that is, the vacant region 26 of the fixed contact 20 in plan view.

As has been described, the containing portion 31*a* is formed in the casing 31. As illustrated in FIG. 6, a pair of projections for sliding 35 that extend in the up-down direction are provided at the centers of front and rear walls defining the containing portion 31*a* for the movement of the operating member 40 in the up-down direction. The width of the projections for sliding 35 in the X direction is appropriately set so as to correspond to the width of the slide grooves 47 of the operating member 40. Thus, the movement of the operating member 40 in the up-down direction is appropriately guided.

Furthermore, a moving-contact mounting hole 39 is formed in a lower left portion of the containing portion 31*a*, and a moving-contact mounting groove 38 extends rightward from the moving-contact mounting hole 39 at the center in a lower portion of the containing portion 31*a*. The moving-contact mounting hole 39 penetrates through the bottom of the casing 31 and is connected to an external space.

The dimension of the moving-contact mounting hole 39 in the Y direction is set to an appropriate dimension corresponding to the width W11 of the terminal 19 of the moving contact 10. Furthermore, the dimension of the moving-contact mounting groove 38 in the Y direction is set to be larger than the width W11 of the second extended portion 13 of the moving contact 10.

Furthermore, a fixed-contact mounting hole 37 is formed at a lower right portion of the containing portion 31*a*, and a pair of fixed-contact mounting shelves 36 extend leftward outside upper ends of both walls in the Y direction and define the moving-contact mounting groove 38. The fixed-contact mounting hole 37 penetrates through the bottom of the casing 31 and is connected to an external space.

The dimension of the fixed-contact mounting hole 37 in the Y direction is set to an appropriate dimension corresponding to the width W23 of the terminal 29 of the fixed contact 20. Furthermore, the distance by which outer edges of the pair of fixed-contact mounting shelves 36 are separated from each other in the Y direction is set to an appropriate value corresponding to the width W21 between both the end portions 21*a* of the plate portion 21.

The moving contact 10, the fixed contact 20, and the operating member 40 having been described are mounted in the containing portion 31*a* of the casing 31. According to the present embodiment, the moving contact 10 is first mounted.

As illustrated in FIG. 7, the second extended portion 13 of the moving contact 10 is placed in the moving-contact mounting groove 38 of the casing 31, and the terminal 19 of the moving contact 10 is press-fitted into the moving-contact mounting hole 39. Since the dimension of the moving-contact mounting groove 38 in the Y direction is set to be larger than the width W11 of the second extended portion 13, the second extended portion 13 can be displaced (deformed) in the casing 31. In contrast, the terminal 19 is firmly secured to the casing 31.

After the moving contact 10 has been mounted, the fixed contact 20 is mounted and held in the casing 31 so as to cover the moving contact 10. In other words, the fixed contact 20 is held by the housing 30 with a space provided on the one surface side (lower surface side) of the plate portion 21.

As illustrated in FIG. 7, also, the pair of connecting portions 27 of the fixed contact 20 are placed on the fixed-contact mounting shelves 36 of the casing 31 and the terminal 29 of the fixed contact 20 is press-fitted into the fixed-contact mounting hole 37. At this time, preferably, both the end portions 21*a* of the plate portion 21 of the fixed contact 20 in a direction (Y direction) intersecting an extending direction (X direction) of the first extended portion 11 of the moving contact 10 are secured to the casing 31.

The distance by which the outer edges of the pair of fixed-contact mounting shelves 36 are separated from each other in the Y direction is set to an appropriate value corresponding to the width W21 between the outer sides of the pair of connecting portions 27, that is, the width W21 between both the end portions 21*a* of the plate portion 21. Accordingly, both the end portions 21*a* of the plate portion 21 of the fixed contact 20 are firmly secured to the casing 31. Likewise, the terminal 29 is firmly secured to the casing 31.

As has been described, the dimension W22 between the pair of connecting portions 27 of the fixed contact 20 is set to be larger than the width W11 of the first extended portion 11 and the second extended portion 13 of the moving contact 10. Accordingly, the widths of the first extended portion 11 and the second extended portion 13 of the moving contact 10 in the Y direction are contained between the pair of connecting portions 27, that is, within the width of the vacant region 26 of the fixed contact 20 in plan view.

Next, the operating member 40 is disposed in the casing 31. The operating member 40 is disposed such that, while the operating portion 43 being on the upper side, the projections for sliding 35 of the casing 31 are inserted through the slide grooves 47 and the projecting end of the projection 45 is in contact with the upper surface of the first extended portion 11 of the moving contact 10. The width of each of the pair of projections for sliding 35 in the X direction is set to be slightly smaller than the width of a corresponding one of the slide grooves 47 of the operating member 40. Thus, the operating member 40 is movable in the up-down direction while appropriately being guided by the projections for sliding 35. After the operating member 40 is disposed, as illustrated in FIG. 2, the operating portion 43 of the operating member 40 is inserted through the opening 50*a* of the cover 50, and the cover 50 is mounted on the casing 31.

Although the operating member 40 is directly disposed above the moving contact 10 and the fixed contact 20 according to the present embodiment, an insulating sheet may be provided between the fixed contact 20 and the operating member 40 so as to provide waterproof properties and dust resistant properties.

Figure 8:
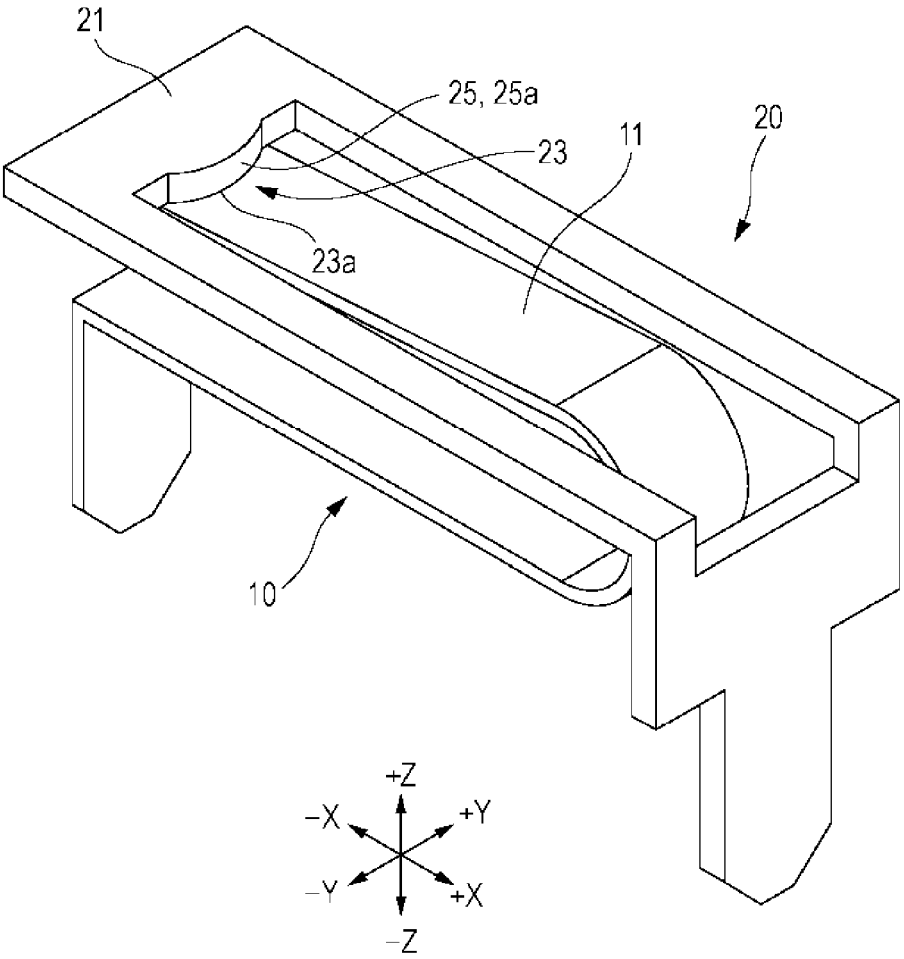
FIG. 8 is a perspective view illustrating the relationship between the moving contact and the fixed contact in a switched-on state.
Figure 9:
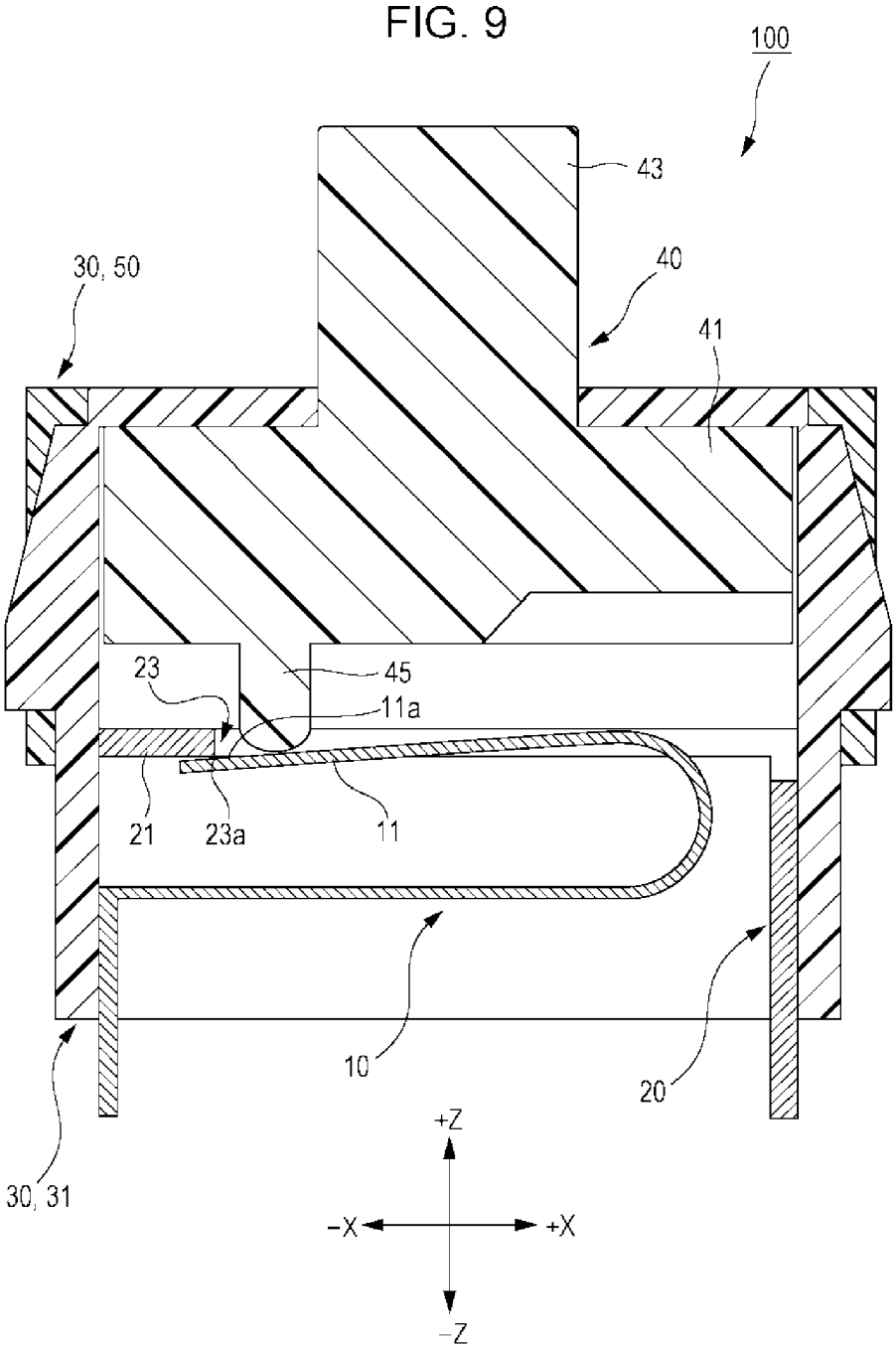
FIG. 9 is a sectional view of a state inside the switch device in the switched-on state.
Figure 10:
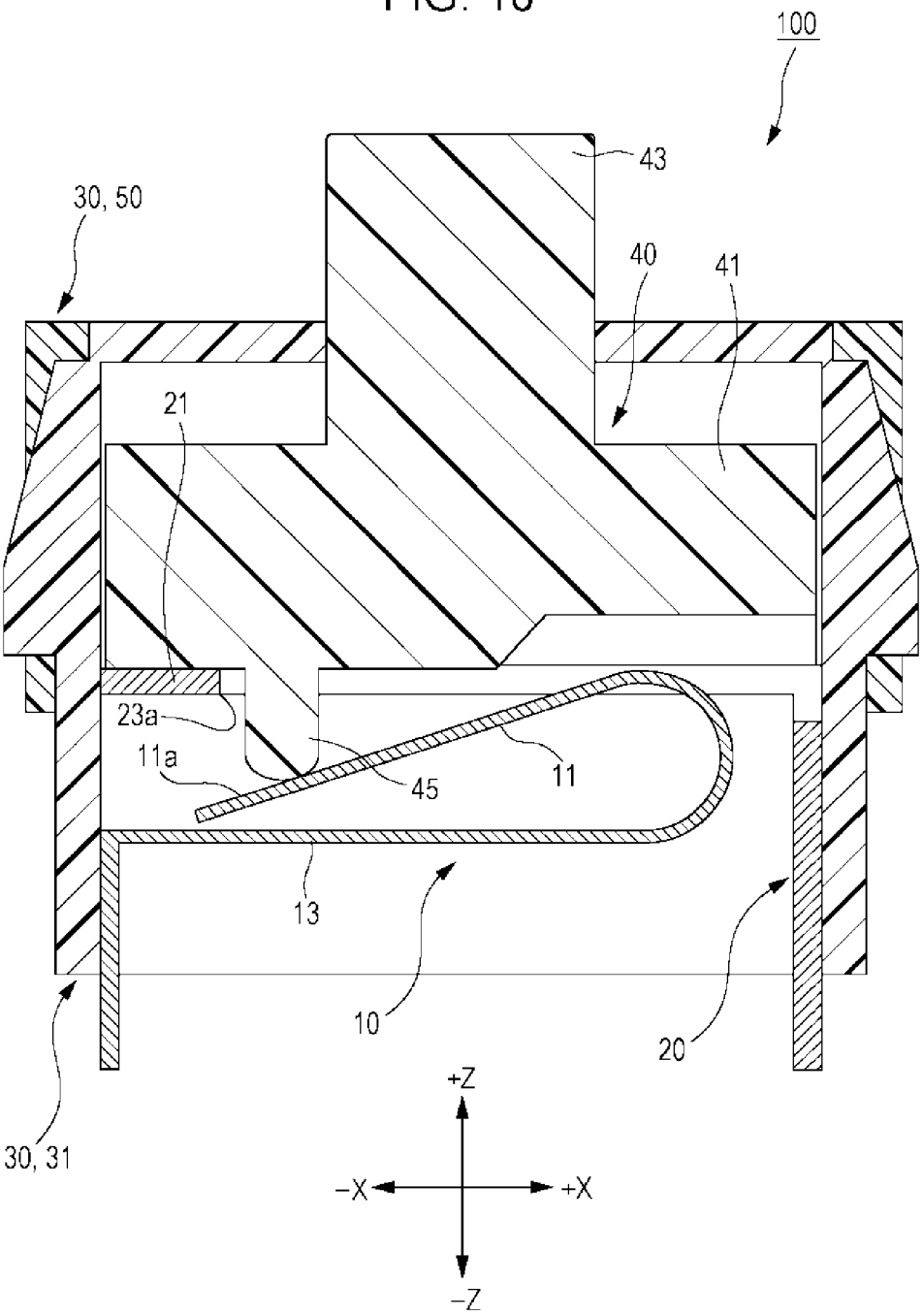
FIG. 10 is a sectional view of a state inside the switch device in the switched-off state.
Figure 11A:
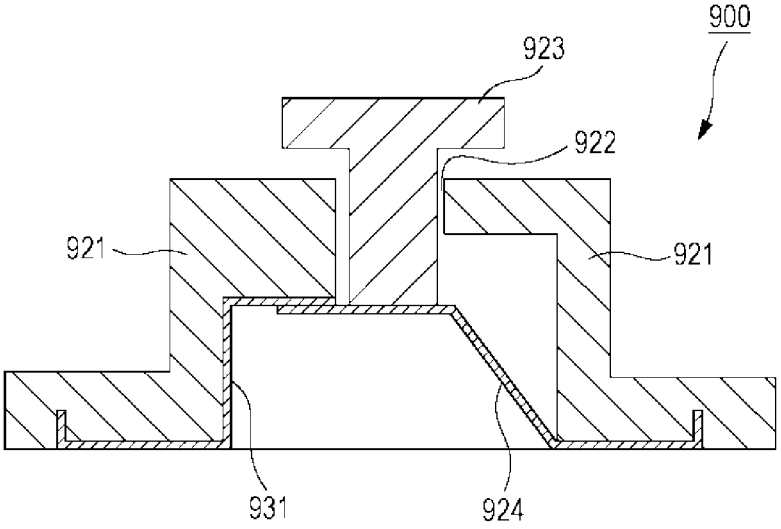
FIG. 11A PRIOR ART
FIGS. 11A and 11B are sectional views of the structure of a related-art switch device.
Figure 11B:
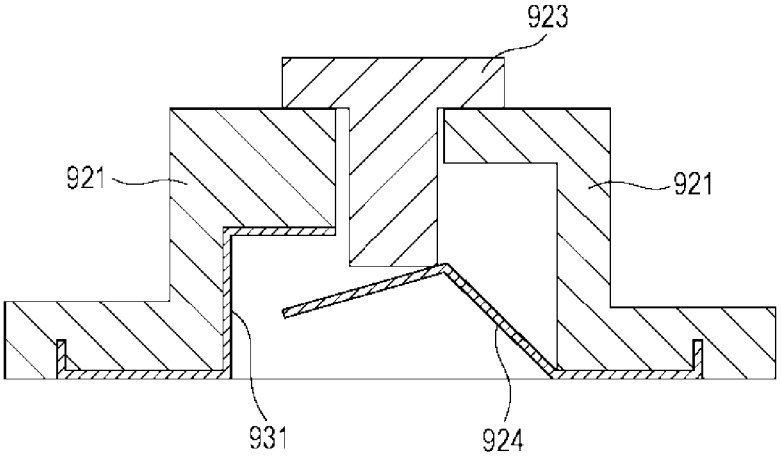
FIG. 11B PRIOR ART

Next, referring to FIGS. 8 to 10, operation of the switch device 100 is described. FIG. 8 is a perspective view illustrating the relationship between the moving contact 10 and the fixed contact 20 in a switched-on state. FIG. 9 is a sectional view of a state inside the switch device 100 in the switched-on state taken along line IX-IX illustrated in FIG. 3A. FIG. 10 is a sectional view illustrating similarly to the FIG. 9 a state inside the switch device 100 in the switched-off state.

The switch device 100 is configured such that, along with a movement of the operating member 40, the moving contact 10 is driven so as to be brought into contact with or brought out of contact from the fixed contact 20. As has been described, before the operating portion 43 of the operating member 40 is pressed, the moving contact 10 is urged by its own elastic force toward the fixed contact 20 and in an elastic contact with the fixed contact 20, thereby the switch device 100 is set in the switched-on state, and when the operating portion 43 is pressed, the moving contact 10 is brought out of contact from the fixed contact 20, thereby the switch device 100 is set in a switched-off state.

Before the operating portion 43 of the operating member 40 is pressed, that is, when the moving contact 10 and the fixed contact 20 are in contact with each other, as illustrated in FIGS. 8 and 9, the moving contact 10 and the fixed contact 20 are in a state in which the first extended portion 11 of the moving contact 10 intersects the plate portion 21 of the fixed contact 20 while the first extended portion 11 being inclined relative to the plate portion 21. Also at this time, preferably, the upper surface of the first extended portion 11 is in elastic contact with the corner portion 23*a* on the one surface side (lower side) of the edge 23 of the plate portion 21. That is, the upper surface of the one end portion 11*a* of the first extended portion 11 is in contact with the corner portion 23*a* at a specified angle from the lower surface of the plate portion 21.

As has been described, the plate portion 21 of the fixed contact 20 includes the projection 25, which has the curved surface 25*a* at its projecting end, on the edge 23 in plan view perpendicular to the plate surface of the plate portion 21. Accordingly, the first extended portion 11 of the moving contact 10 is in elastic contact with the corner portion 23*a* on the one surface side of the curved surface 25*a* of the projection 25. Furthermore, the curved surface 25*a* has an arc shape. With the projection 25 having an arc-shaped curved surface 25*a* provided on the fixed contact 20 as described above, the moving contact 10 and the fixed contact 20 can be in substantially point contact with each other. Furthermore, since the contact between the moving contact 10 and the fixed contact 20 is substantially a point contact, foreign matter is unlikely to be caught between the contacts. Accordingly, contact failure is unlikely to occur.

It is thought that the point contact between the moving contact 10 and the fixed contact 20 may be realized with a downward projection on the plate portion 21 of the fixed contact 20 or an upward projection at the one end portion 11*a* of the first extended portion 11 of the moving contact 10. However, compared to the form in which the projection is provided on the fixed contact 20 or the moving contact 10, processing can be easily performed and the size can be easily reduced with the projection 25, which has an arc-shaped curved surface 25*a*, on the fixed contact 20 in the external shape in plan view according to the present embodiment.

When the switch device 100 is in the switched-on state, that is, when the moving contact 10 and the fixed contact 20 are in contact with each other, the operating member 40 is, due to the elastic force of the moving contact 10, positioned at an uppermost position in the casing 31 as illustrated in FIG. 9, and the upper surface of the main body 41 is in contact with or close to the lower surface of the cover 50. At this time, the projection 45 of the operating member 40 is only in contact with the first extended portion 11 of the moving contact 10, and the first extended portion 11 is not pressed by a force equal to or greater than the weight of the operating member 40. Since the moving contact 10 is formed of an elastic metal plate, the one end portion 11*a* of the first extended portion 11 of the moving contact 10 is in elastic contact with the corner portion 23*a* of the edge 23 of the plate portion 21 of the fixed contact 20. As a result, electrical conduction between the moving contact 10 and the fixed contact 20 is made.

Meanwhile, when the operating portion 43 of the operating member 40 is pressed, as illustrated in FIG. 10, the main body 41 of the operating member 40 is moved downward in the casing 31, and the upper surface of the main body 41 is brought out of contact from the lower surface of the cover 50. When the operating portion 43 is pressed to a lowermost position, the lower surface of the main body 41 is brought into contact with the upper surface of the fixed contact 20. At this time, the projection 45 of the operating member 40 presses the first extended portion 11 of the moving contact 10, thereby pressing down the one end portion 11*a* of the moving contact 10 toward the second extended portion 13. Thus, the one end portion 11*a* of the first extended portion 11 is brought out of contact from the corner portion 23*a* of the edge 23 of the plate portion 21 of the fixed contact 20. By performing the above-described operation, the electrical connection between the moving contact 10 and the fixed contact 20 breaks, thereby the switch device 100 is set in the switched-off state.

Effects obtained by the present embodiment are described below.

The first extended portion 11 of the moving contact 10 is in elastic contact with the corner portion 23*a* of the edge 23 of the plate portion 21 of the fixed contact 20 when the switch device 100 is in the switched-on state. Thus, the contact between the moving contact 10 and the fixed contact 20 is not surface contact, and a contact region between the moving contact 10 and the fixed contact 20 is decreased. This can increase the contact pressure. As a result, reliability of electrically conductive connection can be improved.

Furthermore, with the projection 25 having the curved surface 25*a* provided on the fixed contact 20, the contact between the moving contact 10 and the fixed contact 20 becomes more like point contact, thereby the contact region between the moving contact 10 and the fixed contact 20 can be further decreased. This can further increase the contact pressure, and accordingly, further increase the reliability.

Furthermore, since the curved surface 25*a* of the projection 25 has an arc shape, processing is easy compared to the form in which the projection is provided on the contact. Thus, size reduction is possible.

Furthermore, with the second extended portion 13 provided in the moving contact 10, the length of the moving contact 10 formed of an elastic metal plate can be increased.

Accordingly, stress applied to the moving contact 10 can be decreased. Thus, the urging force can be maintained even when the switch device 100 is used for a long time. Furthermore, since the other end of the second extended portion 13 is separated from and faces the one end portion 11*a* of the first extended portion 11, a combination of the first extended portion 11 and the second extended portion 13 as a whole has a folded shape. Thus, the external size can be reduced.

Furthermore, the plate portion 21 of the fixed contact 20 is constantly urged upward by the moving contact 10 during the switched-on state. However, since both the end portions 21*a* of the plate portion 21 are secured to the casing 31, the fixed contact 20 can reliably receive the moving contact 10.

Furthermore, since the fixed contact 20 has an annular shape, strength of the fixed contact 20 can be improved. Furthermore, the dimension W22 between the pair of connecting portions 27 is set to be larger than the width W11 of the first extended portion 11 and the second extended portion 13 of the moving contact 10. Thus, undesired interference between the moving contact 10 and the fixed contact 20 can be prevented.

Furthermore, punching burrs formed when punching is performed do not remain at the corner portion 23*a* of the edge 23 of the fixed contact 20 where the fixed contact 20 is to be in contact with the moving contact 10. Accordingly, contact between the moving contact 10 and the fixed contact 20 can be stabilized.

As has been described, the first extended portion of the moving contact is in elastic contact with the corner portion of the edge of the plate portion of the fixed contact when the switch device according to the present invention is in the switched-on state. Thus, the contact between the moving contact and the fixed contact is not surface contact, and a contact region between the moving contact and the fixed contact is decreased. This can increase contact pressure. As a result, reliability of electrically conductive connection can be improved.

In should be understood that the present invention is not limited to the above-described embodiment and can be modified in a variety of manners without departing from the gist of the present invention. For example, the switch device in the form of a push switch is used as the switch device 100 according to the present embodiment. However, the switch device is not limited to a push switch and may be a switch device of another form such as a slide switch.

What is claimed is:

1. A switch device comprising:

a housing having an opening;

an operating member that includes an operating portion exposed from the opening and that is movable;

a fixed contact provided in the housing; and a moving contact that is driven along with a movement of the operating member so as to be brought into contact with and brought out of contact from the fixed contact, wherein the moving contact comprises an elastic metal plate and is, while the moving contact is in contact with the fixed contact, urged toward the fixed contact so as to be in elastic contact with the fixed contact, wherein the fixed contact includes a plate portion having a flat plate shape and is held by the housing with a space provided on one surface of a first face of the plate portion located on an opposite side of a second face of the plate portion where the operating member is disposed, and the plate portion having an end face between the first and the second faces, and wherein a corner edge is defined by a vertex where the first face meets the end face, wherein the moving contact includes a first extended portion that extends so as to intersect the plate portion with one end portion of the first extended portion positioned on the one surface of the first face of the plate portion, and wherein, when the moving contact and the fixed contact are in contact with each other, the first extended portion intersects the plate portion while the first extended portion is inclined relative to the plate portion, and the first extended portion is in elastic contact with the corner edge of the plate portion.

2. The switch device according to claim 1, wherein the plate portion of the fixed contact includes a projection at the end, wherein the projection includes a curved surface at least at its projecting end, and wherein the first extended portion of the moving contact is to be in elastic contact with the corner edge portion on one surface side of the curved surface.

3. The switch device according to claim 2, wherein the curved surface has an arc shape.

4. The switch device according to claim 1, wherein the moving contact includes a second extended portion that includes at least one bent portion, and wherein one end of the second extended portion is integrally connected to the first extended portion, and another end of the second extended portion is separated from and faces the one end of the first extended portion.

5. The switch device according to claim 4, wherein the housing includes a casing having a containing portion in which the moving contact is contained, and wherein both end portions of the plate portion in a direction intersecting an extending direction of the first extended portion are secured to the casing.

6. The switch device according to claim 5, wherein the fixed contact includes a pair of connecting portions that are connected to the respective end portions of the plate portion, and the fixed contact has an annular shape, and wherein a dimension between the pair of connecting portions is larger than a width of the first extended portion of the moving contact and a width of the second extended portion of the moving contact.

7. The switch device according to claim 1, wherein the corner edge of the end of the plate portion is manufactured by using a die set for pressing including a die and a punch, and wherein the pressing is performed so that the punch is moved from one-surface-side of the plate portion to be in contact with the moving contact, to another-surface-side of the plate portion.

* * * * *